US005154323A

United States Patent [19]

Query et al.

[11] Patent Number: 5,154,323

[45] Date of Patent: Oct. 13, 1992

[54] AEROSOL APPLICATOR AND ACTUATOR

[76] Inventors: Grady W. Query, P.O. Box 1845, Charlotte, N.C.; O. Grady Query, 147 Wappoo Cr. Dr. Suite 202, Charleston, S.C.

[21] Appl. No.: 643,215

[22] Filed: Jan. 22, 1991

[51] Int. Cl.[5] ..... B67D 5/33

[52] U.S. Cl. ..... 222/153; 222/402.13; 239/588

[58] Field of Search ..... 222/153, 182, 402.1, 222/402.13, 402.14, 402.15, 530, 538, 566, 567, 402.24, 402, 527-529; 239/337, 588; 285/239, 260

[56] References Cited

U.S. PATENT DOCUMENTS

| | | | |
|---|---|---|---|
| 2,968,441 | 1/1961 | Holcomb | 239/588 |
| 3,158,292 | 12/1964 | O'Donnell | 222/402.13 |
| 4,305,528 | 12/1981 | Craig | 222/182 |
| 4,449,647 | 5/1984 | Reed et al. | 222/402.13 |
| 4,858,792 | 8/1989 | De Laforcade | 222/402.1 |
| 4,929,236 | 5/1990 | Sampson | 285/239 |
| 4,941,600 | 7/1990 | Berriochoa et al. | 222/402.13 |

FOREIGN PATENT DOCUMENTS

| | | | |
|---|---|---|---|
| 805203 | 12/1958 | United Kingdom | 239/337 |

*Primary Examiner*—Andres Kashnikow
*Assistant Examiner*—Philippe Derakshani
*Attorney, Agent, or Firm*—B. Craig Killough

[57] ABSTRACT

An aerosol actuator, with applicator, which inhibits the actuator from being separated by the aerosol container when a force is applied to the actuator by the applicator. An actuator button is mounted within an actuator body by a straw which connects the actuator body and applicator to the actuator button, and which acts as a hinge for the actuator button. The actuator body is designed to remain intact on the aerosol body when a force is applied to the end of the applicator by various support rings.

8 Claims, 2 Drawing Sheets

AEROSOL APPLICATOR AND ACTUATOR

BACKGROUND AND SUMMARY OF THE INVENTION

The present invention relates generally to aerosol containers and aerosol packaging, and is specifically directed to an actuator for aerosol containers having a rod which extends there from which allows the dispensation of aerosol materials through the rod.

Various materials are contained within and dispensed by means of aerosol packaging. Numerous compositions are placed within aerosol containers, which are typically metal cans, and by means of an aerosol propellant under pressure, are discharged through a valve located on the aerosol container.

Typically, the aerosol valve is crimped to the top of the aerosol container or can. The aerosol valve has a stem, which is typically a plastic straw, extending through a shoulder of the valve. As the stem is depressed, the valve opens, causing the contents which are under pressure to be dispensed from the aerosol container.

The aerosol valve, and more precisely, the stem of the aerosol valve, is depressed and actuated by what is known as an aerosol actuator. This aerosol actuator is typically a plastic button which rests on top of the valve, and has a seat which contacts the valve stem. The actuator may be depressed by manual means, such as a finger, or mechanical means. As the actuator is depressed, a seat of the actuator contacts the valve stem, and causes depression of the valve stem. The aerosol contents are then dispensed through the valve stem and into the actuator, which has an orifice, commonly a nozzle, through which the contents are expelled from the package. As the actuator is released, the valve is closed by spring biasing.

In certain applications, it is desirable to dispense aerosol compositions or materials through an applicator which may be from several inches to a few feet in length. A common example is the dispensation of insecticides which are contained within aerosol packaging. Insecticides may be dispensed into ant mounds by inserting an applicator rod into the ant mound, and dispensing insecticide within that closed environment. Likewise, insecticides may be dispensed into hornet's nests. Such processes are more fully described in Query, et al, U.S. Pat. No. 4,160,336, Query, et al, U.S. Pat. No. 4,534,128, and Query et al, U.S. Pat. No. 4,624,070. In other applications, the use of a rod to dispense aerosol contents may be desirable, since a rod may be inserted into a container, or a rod may be used for more precise placement of the material from a greater distance.

A problem which is experienced with the use of such rods is the tendency of the rod to cause the actuator to pull away from the top of the aerosol container and the valve. When a rod is mounted to an actuator of the type known in the art, the moment about the point of the aerosol valve is easily sufficient to cause the actuator to pull loose from the valve, even when the force applied at the opposite end of the rod is small. The effect is similar to the use of a bottle opener with a bottle cap which is press fit to the top of the bottle The bottle cap is easily displaced by the use of a lever applied to the bottle cap. Since the moment resulting from the use of a rod one meter or more in length, is great, the aerosol actuator as known in the art will tend to separate from the container as the end of the rod is placed into, for example, an ant mound.

The present invention yields an aerosol actuator which will not release from the container when normal force is applied to the end of the rod. Further, the actuator button of the device as disclosed herein does not directly contact the actuator body, but is hinged upon a straw which extends from the rod and actuator body. The use of the straw securely retains the actuator button, but gives superior feel and control in dispensing the aerosol contents over actuators found in the prior art. The present invention also provides a locking means to prevent accidental discharge of the aerosol contents.

DETAILED DESCRIPTION OF THE PREFERRED EMBODIMENT

Figure 1:
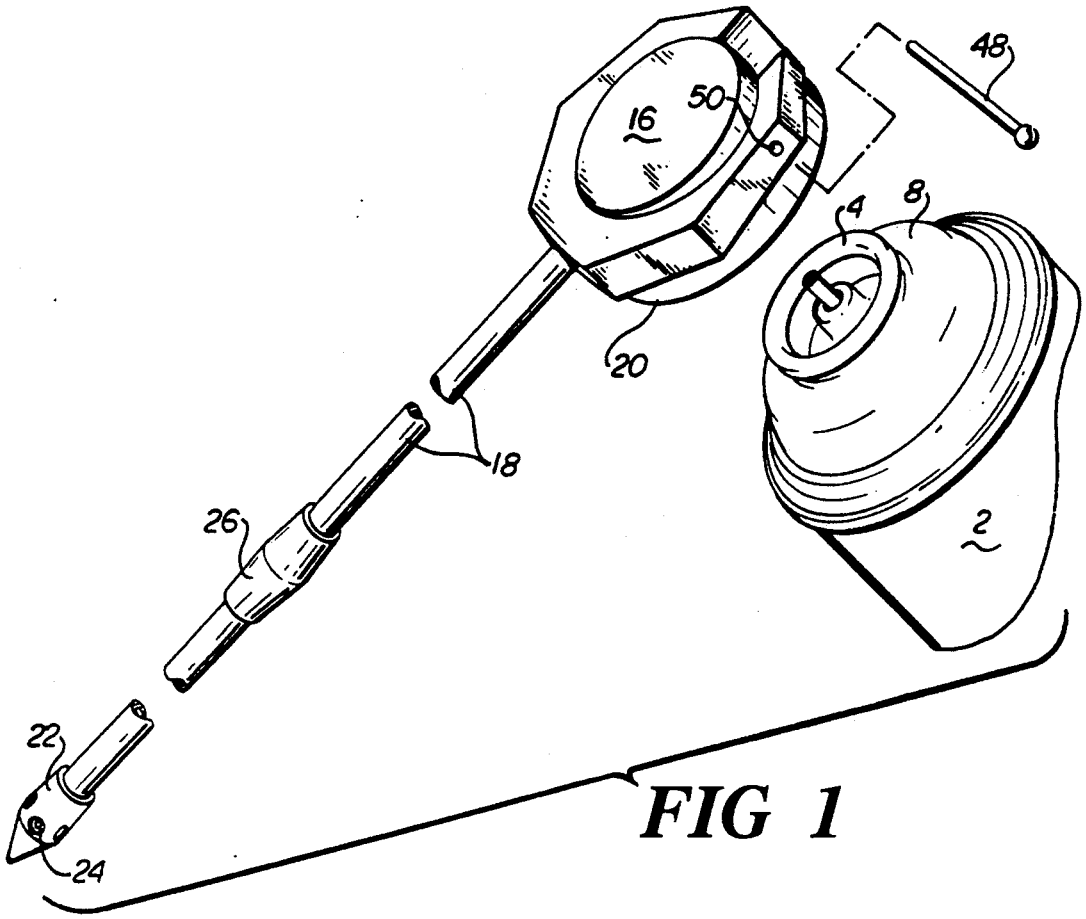
FIG. 1 is a perspective view of the actuator exploded away from the top of the aerosol container, showing the locking pin removed from the actuator.
Figure 3:
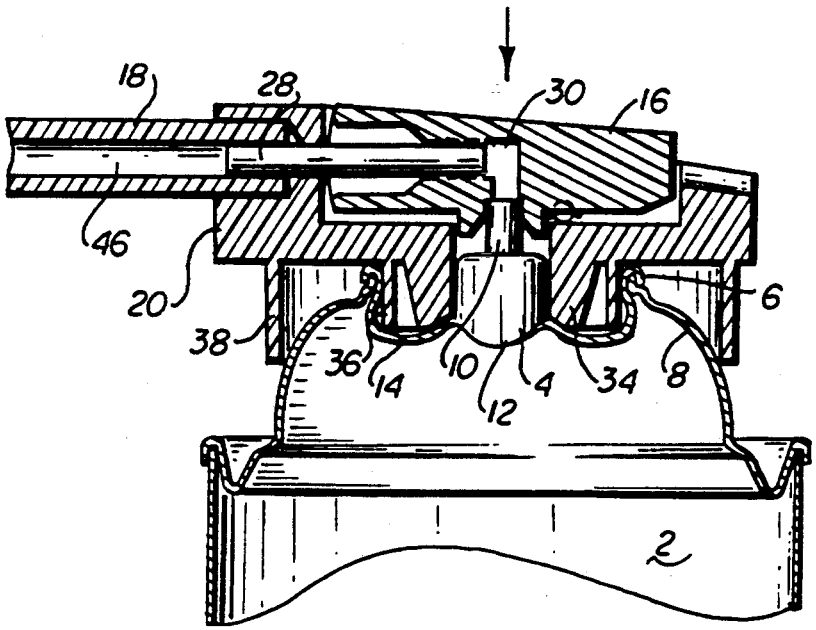
FIG. 3 is a side sectioned view of the aerosol actuator attached to the top of an aerosol container.

A typical aerosol container is shown in FIGS. 1 and 3. A can or cylinder 2, which is typically made of metal, has a valve 4 on one end thereof. This valve is crimped to an opening in the can 2 with the opening being typically circular. The top of the can itself has a shoulder 8, and adjacent thereto is the valve crimp 6. Rising from the center of the valve is a valve stem 10, which passes through the valve shoulder 12. Between the valve crimp 6 and the valve shoulder 12 is a depression within the valve 14.

As the valve stem 10 is depressed the valve is opened, releasing the aerosol contents, which are under pressure, from the aerosol container. The valve stem is depressed by an actuator button 16, through which the released aerosol composition passes as it is received from the valve stem 10.

In the preferred embodiment, the aerosol actuator is used with an applicator, which is a rod 18. This applicator rod 18 is of no particular length, but may be as shown in FIG. 1, and is of sufficient length to dispense the aerosol composition into the ground. The rod extends from the actuator body 20 to direct the aerosol composition through the rod. The aerosol composition escapes from the end of the rod opposite the actuator body. A nozzle 22 may be attached to the end of the rod. The nozzle may be of any typical configuration, having one or more orifices 24 therein. The rod may be one piece, or may be sectional as illustrated in FIG. 1. Joints 26 may be used to attach sections of the rod together for convenient transportation and storage of the rod.

Figure 2:
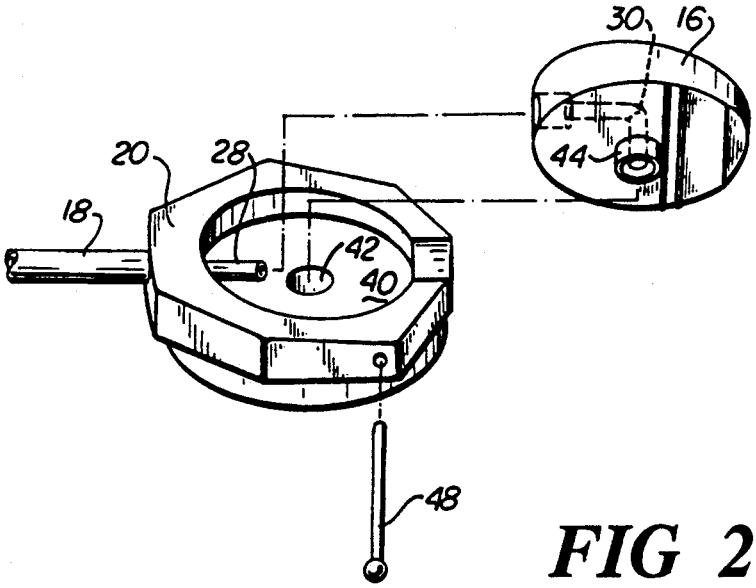
FIG. 2 is a perspective view of the actuator body, with the actuator button removed therefrom, and with the orifice of the actuator shown as a phantom.

The major components of the device are illustrated in FIG. 2. An actuator body 20 is present, into which an actuator button 16 is inserted. The rod 18 extends from one side of the actuator body. A straw 28 extends from the rod toward the center of the actuator body. The actuator button 16 is then placed in a concentric fashion within the actuator body 20, but is not directly in contact with the actuator body. The actuator button is connected to the actuator body by the straw. The actuator button has an orifice 30 therein, which is concentric with the actuator button and the actuator body at the point of contact with the valve stem, and which extends through the actuator button so as to allow the straw to be inserted into this orifice of the actuator button.

FIG. 3 is a sectioned view which shows the relationship of the various elements, including the aerosol container, and the operation of each. The actuator body has an inner ring 34 and an intermediate ring 36. The intermediate ring 36 is typically thinner than the inner ring 34, and as the intermediate ring is forced into the cavity 14 of the valve, it deforms slightly so as to apply pressure at the point of the valve crimp 6. The inner ring is of greater thickness, and does not deform to the extent to which the inner ring does, but contacts the shoulder of the valve to stabilize the actuator body, and to aid the intermediate ring in holding the actuator body in place.

The actuator body has an outer ring 38 which rests against the shoulder 8 of the can. This outer ring further stabilizes the actuator body. As a force is placed on the end 22 of the rod, the moment about the actuator body is relatively great. Downward or upward movement of the end of the rod forces the outer ring against the can shoulder, preventing movement of the actuator body which, in conjunction with the intermediate ring and inner ring, prevents the actuator from being pried loose from the aerosol container.

The actuator body has a cavity 40 therein. Concentric with the cavity is a additional void 42 which extends through the center of the actuator body. The valve stem 10 of the can extends through this concentric void and into the cavity of the actuator body.

Figure 4:
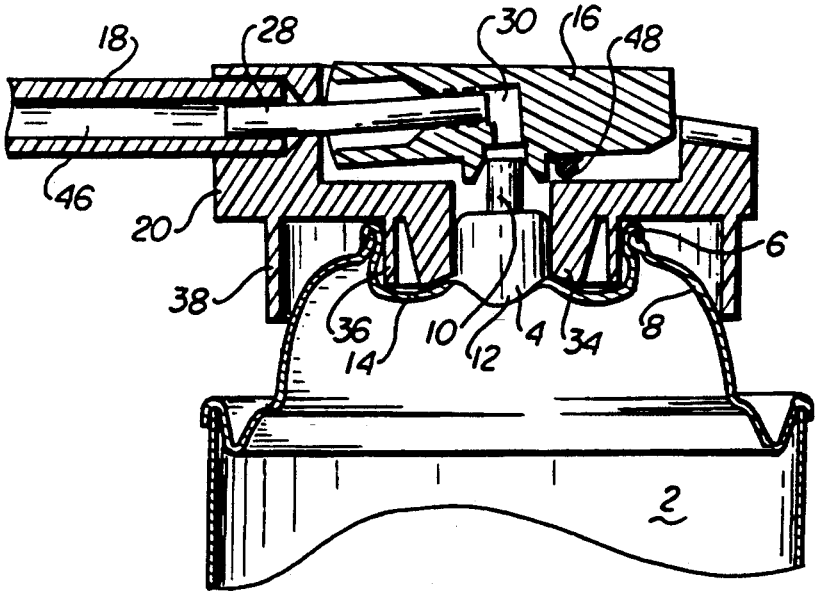
FIG. 4 is a side, sectioned view of the aerosol actuator shown in FIG. 3, with a locking pin in place to prevent use of the actuator.

The actuator button 16 is placed into the cavity 40 of the actuator body. The actuator button has little, if any, direct contact with the actuator body. FIGS. 3,4. The seat 44 of the actuator button 16 contacts and receives the valve stem 10 so as to be able to depress it, but is connected to the actuator body by means of straw 28.

The rod is inserted into a portion of the actuator body in which a horizontal void is present. The straw is inserted into a void within the rod so as to connect the orifice 46 of the rod with the orifice 30 of the actuator button. The straw 28 acts as a conduit to pass the aerosol composition from the orifice 30 to the rod, and it connects the actuator button with the actuator body and the rod. Additionally the straw 28 acts as a hinge for the actuator button as it is displaced within the actuator body to depress valve stem 10.

As the actuator button 16 is displaced downwardly, it depresses the valve stem 10. This causes the valve to open, and the aerosol composition is released from the aerosol container. The aerosol composition then passes through the orifice of the actuator button, through the straw, and into the rod, from which the aerosol composition is dispensed through the nozzle.

The seat 44 of the actuator button where it contacts the valve stem may be chamfered so as to readily accept the valve stem. Ribs may be formed within the orifice of the actuator button which receives the straw to insure an air tight fit between the straw and the actuator button. The straw may be made of any material, which allows it to deform slightly to insure a tight seal, while also acting as a hinge. The actuator button may be easily removed from the actuator body. Typically, in assembling the device, the actuator body, is pressed into place over the aerosol container. The actuator button is then placed within the actuator body which has already been assembled to the can. The actuator button may then be depressed to release the aerosol composition from the aerosol container.

The device may be provided with a locking means. This locking means may be a void which is present within the actuator body, and which extends through to the cavity in which the actuator button is placed. Locking pin 48 is then inserted into the void 50, and extends into the cavity between the actuator button and the actuator body to prevent inadvertent displacement of the actuator button so as to depress the valve stem.

What is claimed is:

1. An aerosol actuator for use with aerosol containers, comprising:

a. an actuator body which mounts to an aerosol container;

b. an actuator button which contacts a stem of a valve of an aerosol container as said actuator button is depressed so as to open said valve and release a composition from said aerosol container;

c. an applicator which is attached to said actuator body through which said composition of said aerosol container is dispensed; and d. a straw having an end which is inserted into an aperture of said actuator button, with an opposite end of said straw inserted through said actuator body and into said applicator, wherein said straw receives said composition as it passes from said actuator button and transports said composition into said applicator, and wherein said straw connects said actuator button and said actuator body and has a flexible property which allows said straw to act as a hinge between said actuator button and said actuator body and applicator, and allows said actuator button to be depressed along a line of travel of the stem.

2. An aerosol actuator for use with aerosol containers as described in claim 1, wherein said aperture of said actuator button which receives said straw is of a diameter which allows said straw to be retained therein by friction so as to hold said straw, and wherein the aperture increases in diameter toward an outer surface of said actuator button through which said straw within said actuator button is received so as to allow for movement of said straw as said straw acts as a hinge.

3. An aerosol actuator for use with aerosol containers as described in claim 1, further comprising a locking pin which is inserted through said actuator body and underneath said actuator button to prevent movement of said actuator button so as to prevent inadvertent release of said composition from said aerosol container, and which may be removed from underneath said actuator button to allow movement of the actuator button to release said composition from said aerosol container.

4. An aerosol actuator for use with aerosol containers, as described in claim 2, further comprising a locking pin which is inserted through said actuator body and underneath said actuator button to prevent movement of said actuator button so as to prevent inadvertent release of said composition form said aerosol container, and which may be removed from underneath said actuator button to allow movement of the actuator button to release said composition from said aerosol container.

5. An aerosol actuator for use with aerosol containers, comprising:

a. an actuator body having an outer support means on a lower surface thereof which rests on a shoulder of an aerosol container, and having a circular intermediate ring which contacts a crimp where a valve of said aerosol container is attached to said aerosol container and having a circular inner support means which contacts a shoulder of said valve through which a valve stem protrudes, with a gap between said intermediate ring and said inner support means, wherein a distance from an outside diameter of said intermediate ring to an inside diameter of said inner support means is greater than a distance from said inside diameter surface of said crimp to a point of contact of said inner support means with said shoulder, so that as said intermediate ring and inner support means are placed between said inside diameter surface and said shoulder, said intermediate ring and said shoulder deflect so as to hold said actuator body on said aerosol container by spring pressure from said deflection, and wherein said intermediate ring completely surrounds said shoulder of said valve to provide a seal;

b. an actuator button which is placed within said actuator body and into which said valve stem is received and which depresses said valve stem as said actuator button is depressed so as to open said valve and release a composition from said aerosol container, and having a orifice therein through which said composition is transported;

c. an applicator which extends from said actuator body, and which receives said contents from said aerosol container and said actuator button as said composition are discharged from said aerosol container; and d. a straw which connects said actuator button and said actuator body through which said composition is transported, and on which said actuator button is hinged.

6. An aerosol actuator for use with aerosol containers as described in claim 5, wherein said straw has an end which is inserted into said actuator button, with an opposite end of said straw inserted through said actuator body and into said applicator, wherein said straw receives said composition as it passes from said actuator button and transports said composition into said applicator, and wherein said straw connects said actuator button and said actuator body and has a flexible property which allows said straw to act as a hinge between said actuator button and said actuator body and applicator, and allow said actuator button to be depressed along a line of travel of the stem.

7. An aerosol actuator for use with aerosol containers as described in claim 6, wherein said actuator button has an aperture therein which receives said straw and is of a diameter which allows said straw to be retained therein by friction, and wherein the aperture increases in diameter toward the outer surface of said actuator button through which said straw is received so as to allow for movement of said straw within said actuator button as said straw acts as a hinge.

8. An aerosol actuator for use with aerosol containers, as described in claim 5, further comprising a locking pin which is inserted through said actuator body and underneath said actuator button to prevent movement of said actuator button so as to prevent indavertent release of said composition from said aerosol container, and which may be removed from underneath said actuator button to allow movement of the actuator button to release said composition from said aerosol container.

* * * * *